United States Patent [19]

Corso

[11] Patent Number: 4,986,444

[45] Date of Patent: Jan. 22, 1991

[54] GUNS INTENDED FOR EXTRUDING PASTRY PRODUCTS

[76] Inventor: Dominique Corso, Rue de la Plaine, 38230 Charvieu, France

[21] Appl. No.: 408,908

[22] Filed: Sep. 13, 1989

[30] Foreign Application Priority Data

May 9, 1989 [FR] France ..... 89 06328

[51] Int. Cl.[5] ..... B05C 17/005; B67D 5/46

[52] U.S. Cl. ..... 222/23; 222/95; 222/327; 222/389

[58] Field of Search ..... 222/82–83.5, 222/85–87, 95, 105, 325–327, 386.5, 389, 23, 396–397

[56] References Cited

U.S. PATENT DOCUMENTS

| | | | |
|---|---|---|---|
| 2,733,836 | 2/1956 | Switzer | 222/82 |
| 3,077,078 | 2/1963 | Hamilton | 222/82 X |
| 3,212,684 | 10/1965 | Svensson et al. | 222/326 |
| 3,501,063 | 3/1970 | Sundholm | 222/326 |
| 4,136,801 | 1/1979 | Pavenick | 222/95 X |
| 4,231,492 | 11/1980 | Rios | 222/1 |

FOREIGN PATENT DOCUMENTS

| | | |
|---|---|---|
| 52060 | 5/1982 | European Pat. Off. . |
| 2607442 | 8/1976 | Fed. Rep. of Germany . |

*Primary Examiner*—Michael S. Huppert
*Attorney, Agent, or Firm*—Dowell & Dowell

[57] ABSTRACT

A gun for dispensing pasty products which includes a piston seal member mounted between a cylinder and a cartridge and through which gas under pressure passes from the cylinder to a supply container in communication with the cartridge wherein the piston seal member includes a pair of annular lips of differing diameters and an inner skirt which provide for selective sealing between the cylinder and the cartridge whenever pressure is applied to the cylinder.

10 Claims, 4 Drawing Sheets

GUNS INTENDED FOR EXTRUDING PASTRY PRODUCTS

BACKGROUND OF THE INVENTION

1. History of the Related Art

It is known that pasty products such as lutes, glues, greases, etc. . . are stored in cartridges or in bags constituted by a supple envelope preferably made of aluminum foil.

European Pat. No. 0052 060 describes a gun intended for discharging the products in question. Such a gun comprises a bored piston disposed in an open cylinder connected to a source of pressurized gas and which in addition ensures tight closure of the base of the cartridge by a rounded peripheral contour.

It will be readily understood that, if the free end of the skirt of the cartridge is damaged, a seal is not ensured, so that an appreciable loss of pressure appears to the detriment of the good general functioning of the gun.

2. Object of the Invention

The improvements forming the subject matter of the present invention aim at overcoming the aforementioned drawback and at allowing production of a piston adapted to ensure tightness either with a cartridge even in the case of a defect in the free edge of its skirt, or with a tubular sleeve in which is placed a charge of pasty product enclosed in a supple envelope.

The invention also aims at providing a free piston which makes it possible to use the tubular sleeve simply by turning over after expulsion of the charge of pasty product.

Finally, the invention aims at a particular tubular structure which allows the use of bellows whose bottom actuates the piston of the cartridge or that of the sleeve in order to avoid any possibility of transfer of compressed gas towards the product to be discharged.

BRIEF DESCRIPTION OF THE DRAWINGS

The accompanying drawings, given by way of example, will enable the invention, the characteristics that is presents and the advantages that it is capable of procuring, to be more readily understood.

DESCRIPTION OF THE PREFERRED EMBODIMENT

Figure 1:
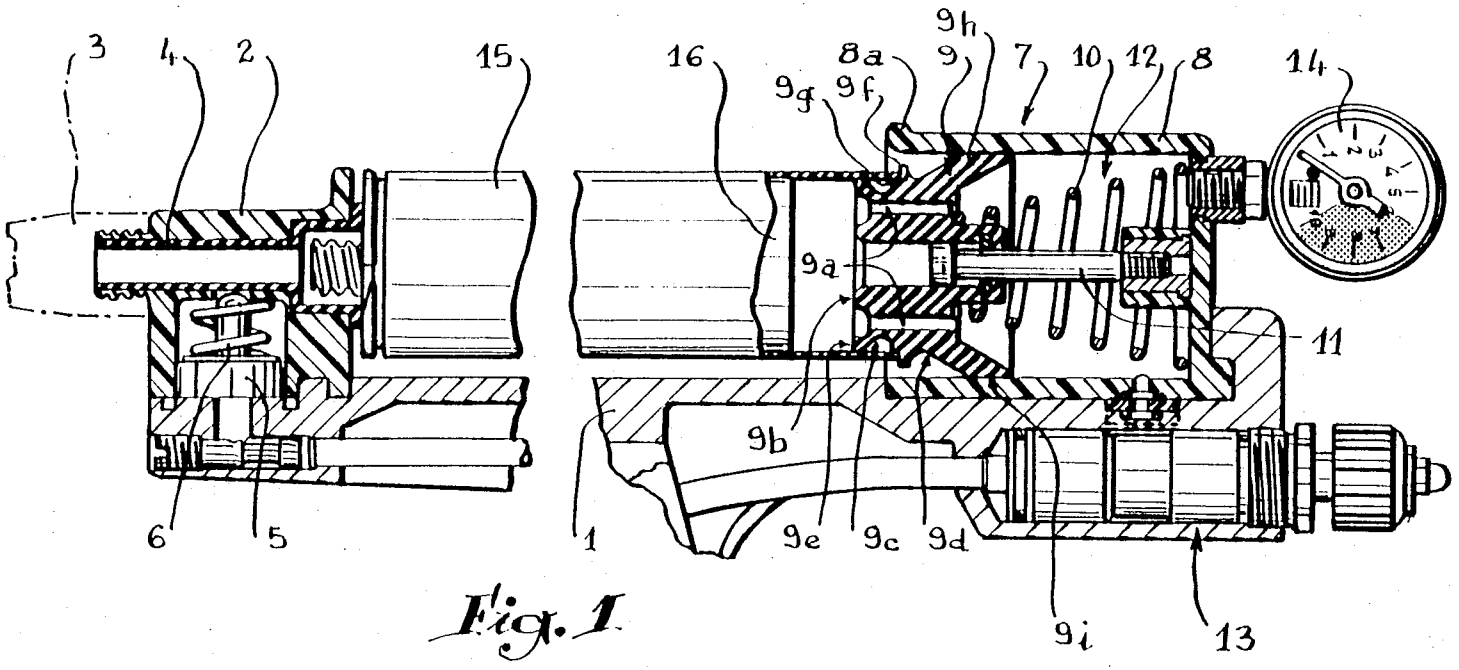
FIG. 1 is a partial section of a gun according to the invention, using a commercially available cartridge.

FIG. 1 illustrates in a partial view a gun according to the invention comprising a reinforcement or base 1 provided with a handle (not shown) to which may be connected a source of pressurized gas. At the front of the reinforcement 1, there is provided a block 2 provided with a discharge spout 3 which contains a supple or flexible tube 4 capable of being deformed by a piston 5 urged downwardly by a spring 6 when the user presses on a trigger (not shown), which cuts off the admission of compressed gas to the head of the piston 5. This block is described in Applicants' European Pat. No. 0052 060 and its functioning will not be described.

The European Patent also describes an open jack 7 (FIG. 1) located at the end of the reinforcement 1 opposite the block 2 and which comprises an open cylinder 8 containing a seal 9 which is movable as a piston and which is urged outwardly by a spring 10. A threaded shaft 11 prevents the piston seal 9 from leaving the cylinder 8. The piston seal 9 determines with the cylinder a chamber 12 placed under pressure when the user acts on the trigger (not shown), at the same time as the pressure supply to the piston 5 is eliminated. It will be observed that, according to the invention, the supply of pressurized gas is effected through a pressure reducing valve 13 making it possible to adjust the pressure prevailing in the chamber and which may be monitored by means of a pressure gauge 14. The pressure may thus be adjusted to the desired value. This pressure is transmitted outwardly via longitudinal holes *9a* made in the piston seal 9.

In accordance with the invention, the piston seal comprises, from its outer end *9b* at the level of which open exhaust holes *9a*, two peripheral grooves *9c*, *9d* disposed in tandem, the one referenced *9c* being disposed nearest the outer end *9b* and defining therewith a first radial lip *9e*, while, between the two grooves *9c*, *9d* is located a second lip *9f* whose diameter is greater than that of *9e*. The transverse wall of the second lip *9f* is provided on the groove *9c* side, with a shoulder *9g* whose diameter is slightly smaller than that of the lip *9e* in the free state, for reasons which will be better explained hereinbelow. The piston seal 9 comprises, opposite its outer end *9b*, a divergent conical skirt *9h* with cylindrical lateral wall *9i* whose diameter is larger than that of the second lip *9f*. Of course, the diameter of the bottom of the groove *9c* is very clearly smaller than that of groove *9d*.

In this way, when a cartridge 15 containing a pasty product (not shown) limited by a piston 16 which constitutes a movably bottom which is disposed in the open skirt of the cartridge 15 is placed as illustrated in FIG. 1, the first lip *9e* is slightly compressed and is applied against the inner wall of the skirt and also cooperates with the periphery of the shoulder *9g*, so that the groove *9c* constitutes a tight chamber. When the pressure is applied in the cylinder 8, it prevails against the piston 16 of the cartridge 15 so that the latter penetrates little by little to cause discharge of the pasty product via the spout, as needed. The pressure prevailing between the piston seal 9 and the piston 16 applies the lip *9e* firmly against the inner wall of the skirt of the cartridge 15 in order to produce an excellent seal, all the more so as the space constituted by the groove *9c* is not under pressure, so that the pressure is more reliably maintained even if the cartridge tends to be deformed outwardly.

If it is desired to employ a pasty product disposed in a supple envelope 17 such as aluminum foil, this charge is disposed in a tubular sleeve 18 used as a cartridge and which contains a freely movable piston 19. The free piston lies at a certain distance from one of the ends of the sleeve 18, which may thus engage around the piston seal 9. Such cooperation is effected in manner similar to that of the skirt of cartridge 15, but, in that case, the inner wall of the tubular sleeve cooperates with the second lip **9*f* of base 9, while its free edge comes into abutment against the conical skirt 9*h* of piston seal 9. There again, when the compressed gas arrives at the front of the piston seal, it straightens the lip 9*f* against the inner wall of the tubular sleeve 18, the space constituted by groove 9*d*** being tight.

The free piston 19 is formed by a web **19*a* provided with a peripheral seal 20 and presenting two concave end walls with each of which a star-shaped scraper 21**, also provided to be concave, cooperates.

The displacement of the free piston 19 under the effect of the compressed gas brings about the flow of the pasty product contained in the envelope 17 after it has been cut at its end opposite the end cooperating with piston 19. Of course, the end of the tubular sleeve 18 opposite the one which cooperates with the piston seal 9 is closed by an endpiece 22 presenting a wall **22*a* which includes axial tabs 22*b* which penetrate in that part of the envelope 18** which engages the wall.

Figure 3:
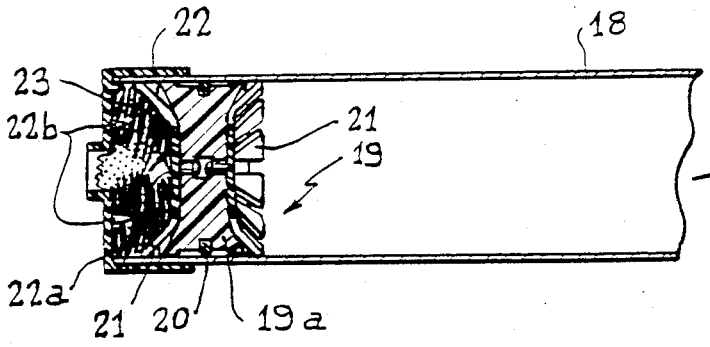
FIGS. 3 to 5 illustrate the way of eliminating the supple envelope of the charge of pasty product at the end of discharge of the product.

When all the product is expelled, as illustrated in FIG. 3, the envelope 17 is flattened and forms scrap 23 constituted by multiple folds.

Figure 4:
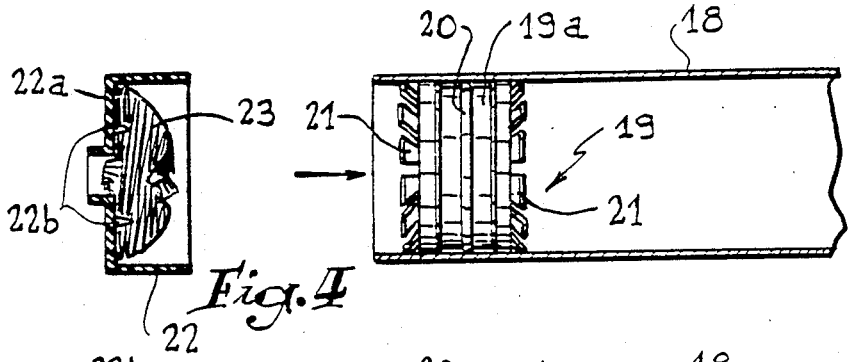
Figure 5:
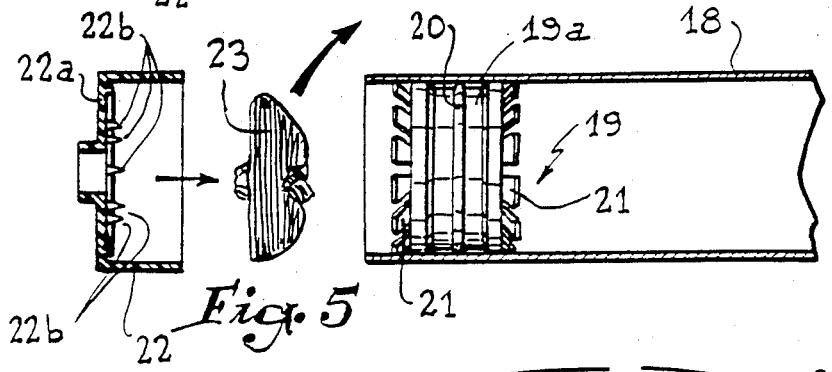

As illustrated in FIG. 4, this scrap remains associated with the endpiece 22 thanks to the presence of the tabs **22*b*. It may therefore be easily extracted from the endpiece, as illustrated in FIG. 5**, and eliminated.

Figure 2:
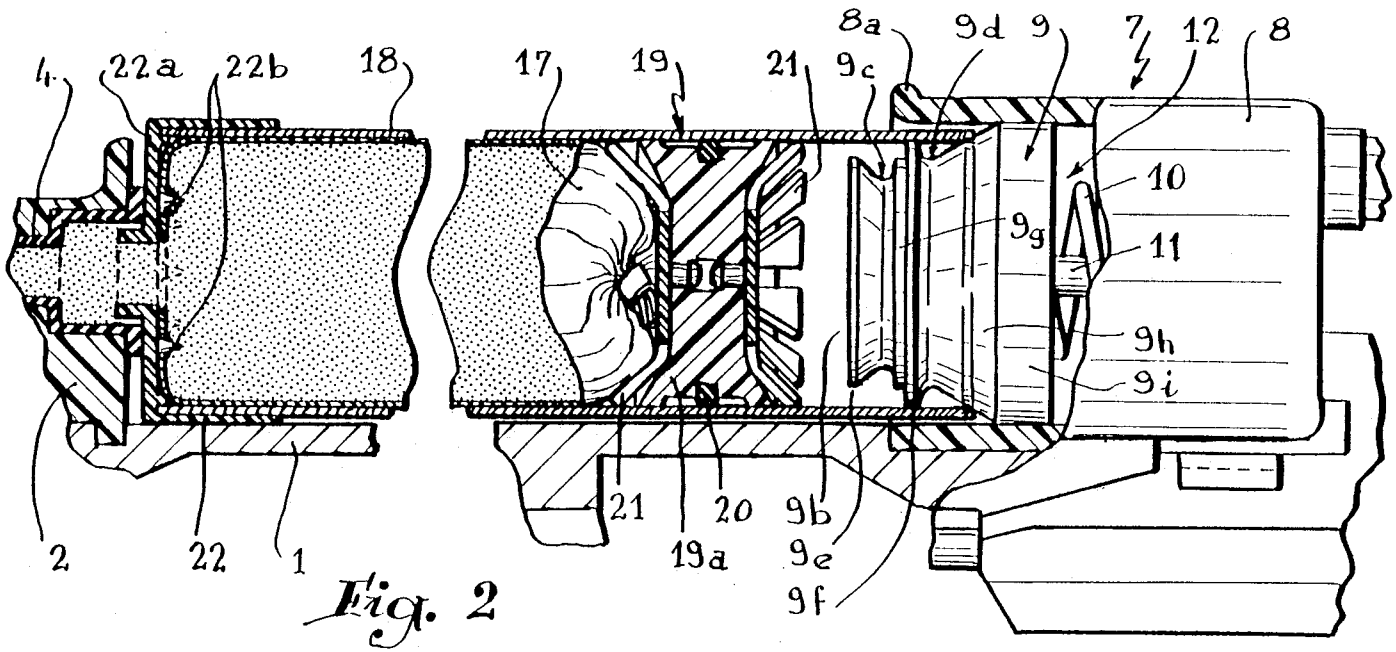
FIG. 2 is a view similar to that of FIG.. 1, but illustrating the gun during use of a charge of pasty product enclosed in a supple envelope.
Figure 6:
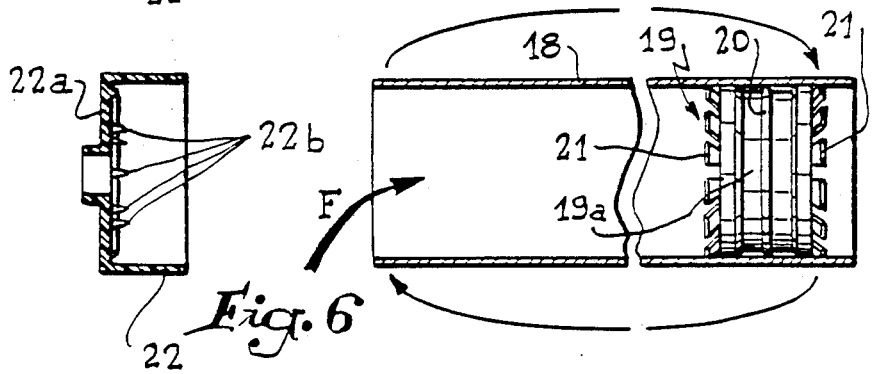
FIG. 6 shows how the tubular sleeve is turned over in order to use a new charge of pasty product.

If it is desired to place a fresh charge in the tubular sleeve 18, it suffices to turn the latter over as illustrated in FIG. 6, to place the charge in the direction of arrow F, to position the endpiece and to dispose this assembly in the gun, as illustrated in FIG. 2.

Figure 7:
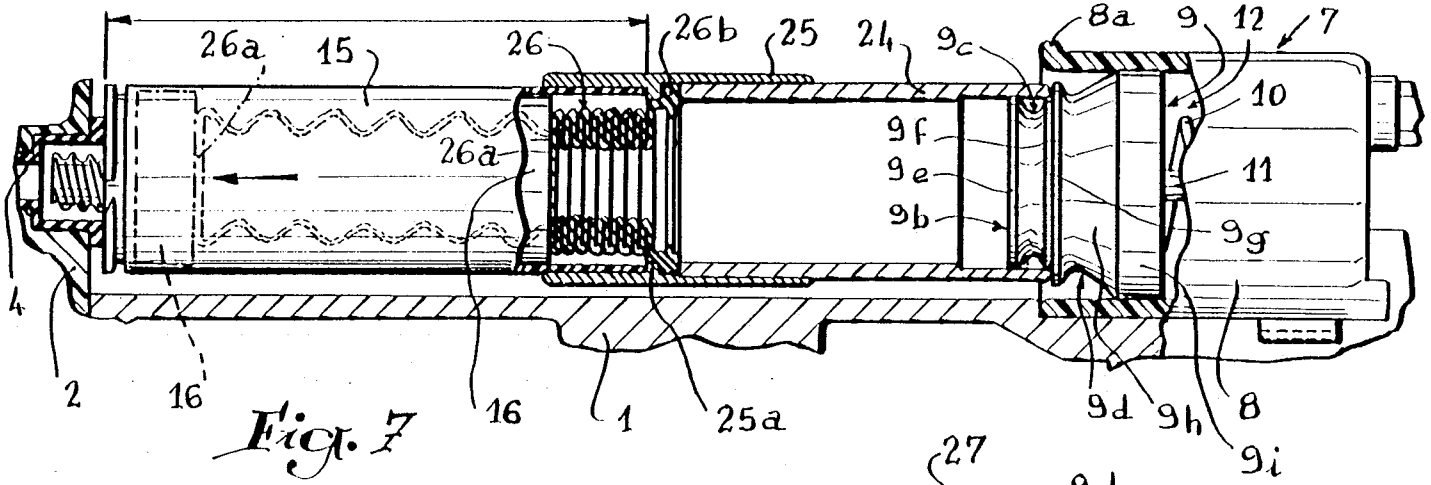
FIG. 7 shows a particular structure allowing the use of bellows for the actuation of the piston of a cartridge or a tubular sleeve containing a charge enclosed in a supple envelope.

FIG. 7 illustrates a tubular structure which is constituted by a tube or cartridge member 24 of which one of the ends comprises an inner diameter equal to that of the cartridge 15, so that it cooperates with the first lip **9*e* and with the shoulder 9*g*. This tube 24 extends within in a spacer member 25 which comprises an inner flange 25*a*. In the spacer member 25 there have been previously disposed bellows 26 comprising an end wall 26*a*, while the other end wall is provided with a peripheral flange 26*b* which is sandwiched between the tube 24 and the flange 25*a* of the spacer member 25. That part of the spacer members opposite the one which receives the tube 24 presents a diameter such that it may receive for example a cartridge 15 provided with its piston 16**.

In order to discharge the product contained in the cartridge 15, the piston 16 is displaced by bellows 26 which expands until the piston has accomplished its stroke. Thanks to the use of these bellows, the hermetic distribution of the product contained in a cartridge and comprising fine and hard grains such as quartz, is ensured. Such grains risk being interposed between the piston 16 and the skirt of the cartridge, provoking scratches, therefore admissions of gas in the product to be discharged.

Of course, a spacer member 25 may be provided of which the inner diameter is adapted to receive a tubular sleeve of type 18 for the extrusion of a product contained in a charge in a supple packing.

Figure 8:
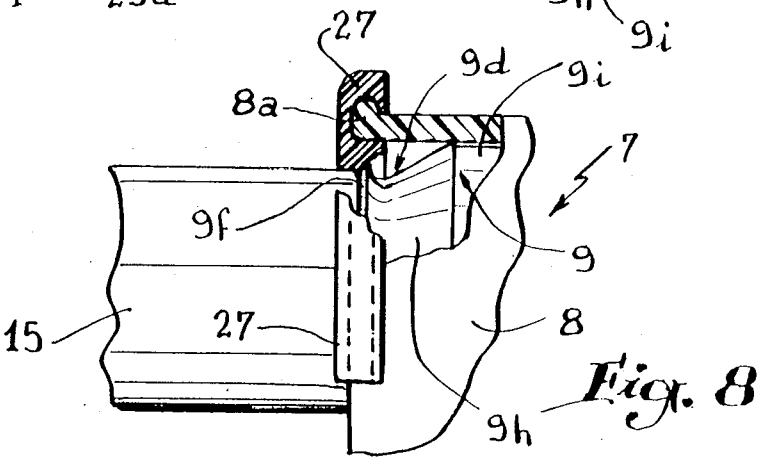
FIG. 8 is a detailed view showing the use of a ring sector for maintaining the base of a cartridge of pasty product.

FIG. 8 illustrates a ring sector 27 adapted to clip on the end bead **8*a* of the cylinder 8 and of which the inner diameter corresponds to that of the cartridge 15 so as to prevent any outward deformation of the latter at the level of lip 9*e* with a view to ensuring perfect tightness at that spot. Of course, it is unnecessary to use such a ring with a tubular sleeve 18 or a tube 24** which may be provided, for example, to be metallic, so as to undergo no centrifugal deformation under the effect of the pressure.

It must, moreover, be understood that the foregoing description has been given only by way of example and that it in no way limits the domain of the invention which would not be exceeded by replacing the details of execution described by any other equivalents.

I claim:

1. In a gun for dispensing pasty products which includes a cylinder into which compressed gas is charged and which gas passes through a piston seal member which substantially closes one end of the cylinder so that the gas is directed through a cartridge to a piston means which acts to discharge a product from a supply container through a nozzle, the improvement comprising; said piston seal member having inner and outer ends and an outer surface, said inner end being in sealing engagement with the one end of the cylinder, first and second peripheral grooves in the outer surface of said piston seal member and spaced inwardly of said outer end thereof, a first radial lip of a first diameter formed between said first groove and said outer end, a second radial lip of a second diameter which is larger than said first diameter formed between said first and second grooves, said inner end being formed as a conical skirt extending radially outwardly relative to said second groove and having a diameter greater than said second diameter, and at least one gas passage way extending through said piston seal member whereby when gas pressure is supplied to the cylinder, such pressure will act to force one of said first and second radial lips into a sealed engagement with the cartridge.

2. The dispensing gun of claim 1 in which said second radial lip includes a shoulder portion spaced inwardly of the outermost surface thereof and toward said inner end of said piston seal member, said shoulder having a diameter which is less than said first diameter when no pressure is supplied to the cylinder.

3. The dispensing gun of claim 1 in which the cartridge has an inner diameter which is substantially the same as said first diameter of said first radial lip.

4. The dispensing gun of claim 3 in which the cartridge is in the form of a tubular element having an inner diameter an the supply container is in the form of a supple envelope, said second diameter of said second radial lip being substantially equal to the inner diameter of the tubular element.

5. The dispensing gun of claim 4 including a movable piston means disposed within said tubular element.

6. The dispensing gun of claim 5 in which said tubular element includes an end wall adjacent the nozzle, and tab means extending inwardly from said end wall and toward the supple envelope.

7. The dispensing gun of claim 6 in which said movable piston includes opposite concave faces and a concave star-shaped scraper means extending outwardly from each of said faces.

8. The dispensing gun of claim 1 in which the one end of the cylinder includes an annular bead, a flexible ring member seated over said bead, said ring member having an inner portion which engages the outer surface of the cartridge.

9. The dispensing gun of claim 1 including a reducing valve communicating with the cylinder for regulating the pressure therein and gauge means communicating with the cylinder to reflect the gas pressure therein.

10. The dispensing gun of claim 1 including an elastic bellows mounted between the cartridge and the supply container, said bellows having a base and being expandable by the gas passing through said piston seal member, and means for retaining said base relative to the cartridge.

* * * * *